US005168781A

United States Patent [19]

Tenuta

[11] Patent Number: 5,168,781

[45] Date of Patent: Dec. 8, 1992

[54] DRIVE SOCKET

[75] Inventor: Ralph D. Tenuta, Mt. Prospect, Ill.

[73] Assignee: Illinois Tool Works Inc., Glenview, Ill.

[21] Appl. No.: 779,960

[22] Filed: Oct. 21, 1991

[51] Int. Cl.[5] ..... B25B 13/04

[52] U.S. Cl. ..... 81/121.1; 81/125; 81/55

[58] Field of Search ..... 81/121.1, 125, 55

[56] References Cited

U.S. PATENT DOCUMENTS 3,779,105 12/1973 Triplett et al. ..... 81/124.5

FOREIGN PATENT DOCUMENTS 3338217 5/1985 Fed. Rep. of Germany ..... 81/125

*Primary Examiner*—Bruce M. Kisliuk
*Assistant Examiner*—Lawrence Cruz
*Attorney, Agent, or Firm*—Schwartz & Weinrieb

[57] ABSTRACT

A drive socket for driving a fastener having a head into a workpiece, and constructed according to the teachings of the present invention, comprises a movable member having a socket and a sleeve having a bottom end. The movable or socket member is capable of axial movement with respect to the surrounding sleeve. An actuable member connects the movable member to the sleeve. The socket member is offset a predetermined distance upwardly from the bottom end of the sleeve. The actuable member positively restricts the axial movement of the movable member with respect to the sleeve so as to permit changing of the distance between the socket and the bottom end of the sleeve from a distance somewhat larger than the axial thickness of the head of the fastener to a distance substantially equal to the thickness of the head of the fastener in order to fully seat the fastener within the workpiece.

15 Claims, 2 Drawing Sheets

DRIVE SOCKET

FIELD OF THE INVENTION

The present invention relates generally to drive sockets, and more particularly to a novel construction for a drive socket useful for driving fasteners into a workpiece.

BACKGROUND OF THE INVENTION

In many modern construction jobs, speed is of the essence. Many construction firms are offered hefty bonuses for finishing a construction job either ahead of schedule, on time, or under budget. Accordingly, many construction firms and employees thereof are under constant pressure to increase their performance speed.

Some of these pressures spurred the creation of power tools or elements thereof for inserting fasteners into a workpiece. For instance, many modern dwelling and business office building structures employ a plurality of panels of gypsum board, commonly referred to as drywall, in forming walls and ceilings instead for using plaster. Specifically, a skeletal framework is erected and is comprised of a plurality of vertically extending studs, which may be formed of metal. The studs are located so as to provide support for the drywall panels. In order to the construction, the drywall panels are fixedly attached to the studs by means of a plurality of threaded fasteners. Although nails, or similar fasteners, can be used, the use of threaded fasteners produces walls and ceilings having greater aesthetic appeal and greater structural integrity.

However, drilling a pilot hole for each individual threaded fastener, and then threadibly inserting the fastener therein can be quite time consuming and labor intensive, which therefore of course adds to the cost of the job. In order to save time and effort, power tools and attachments therefor have been constructed having an axial recess for accepting the head of a fastener. The power tool is then energized, applying torque to the fastener, and drilling it through the drywall and into the metal studs, thereby joining the drywall panels to the studs.

However, use of these power tools and attachments has certain disadvantages. Specifically, the tools may not fully seat the threaded fasteners within the studs. If this occurs, then a workman must go back and fully seat each fastener separately. This is inefficient, and can lead to increased costs. Additionally, if a workman tries to fully seat the fastener initially, he may mar or deform the surface of the drywall, possibly mandating its replacement or repair, adding further costs to the particular construction job.

Furthermore, it is possible that the threaded fastener can be overtorqued upon its insertion. Specifically, an excessive amount of torque can be applied to the fastener after it has been fully seated. This can result in the stripping of the fastener's threads, or the threads of the complementary hole defined within the stud. In this case, the fastener must be replaced. This too can add to the costs of the construction job. The present invention is intended to assist in solving these, among other, drawbacks of inserting threaded studs into a workpiece.

U.S. Pat. No. 3,965,510 shows a fastener-driving structure in FIGS. 8, 9, and 10 which, while designed to drive fasteners to the optimum setting, can sometimes disengage from the driving relationship with the fastener before the fastener is fully driven into the workpiece.

OBJECTS OF THE INVENTION

A general object of the present invention is to provide an improved construction for a drive socket for driving fasteners into a workpiece. Another object of the present invention is to provide a drive socket which is capable of fully seating a fastener within a workpiece before declutching the engagement defined between the socket and the fastener.

A more specific object of the invention is to provide a drive socket having a spring which is compressible so as to reduce the distance defined between a fastener head receiving end of the socket and the end of a sleeve which is engageable with a workpiece so that the fastener can be seated upon the workpiece.

An additional object of the invention is to provide a drive socket which is capable of fully seating a fastener within a workpiece without overtorquing the fastener.

A further object of the present invention is to provide a drive socket having a sleeve and a movable portion which is capable of relative spring-biased axial movement.

SUMMARY OF THE INVENTION

A drive socket for driving a fastener, having a head, into a workpiece, and constructed according to the teachings of the present invention, comprises a movable member having a socket, and a sleeve having a bottom end. The movable or socket, member is capable of axial movement with respect to the surrounding sleeve. An actuable member connects the movable member to the sleeve. The socket member is offset, a predetermined distance, upwardly from the bottom end of the sleeve. The actuable member positively restricts the axial movement of the movable member with respect to the sleeve so as to permit changing of the distance defined between the socket and the bottom end of the sleeve from a distance which is somewhat larger than the axial thickness of the head of the fastener to a distance which is substantially equal to the thickness of the head in order to fully seat the fastener within the workpiece.

BRIEF DESCRIPTION OF THE DRAWINGS

The organization and manner of the structure and operation of the invention, together with further objects and advantages thereof, may best be understood by reference to the following description when taken in connection with the accompanying drawings, wherein like reference numerals identify like elements throughout the various different views thereof, and in which.

DETAILED DESCRIPTION OF THE PREFERRED EMBODIMENT

Figure 1:
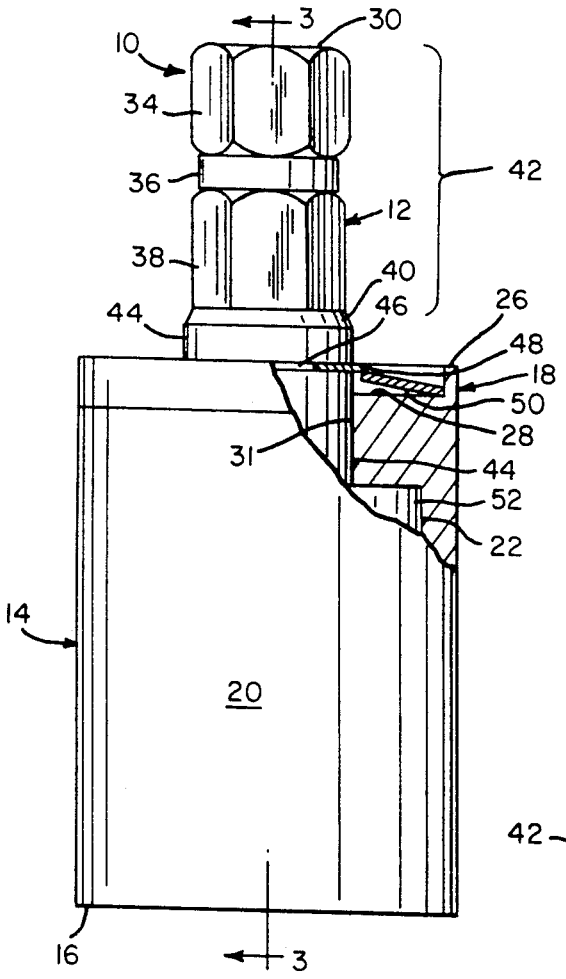
FIG. 1 is a partially sectioned view of a drive socket, constructed according to the teachings of the present invention.
Figure 2:
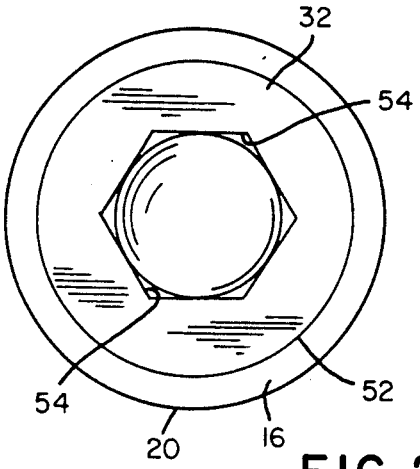
FIG. 2 is a bottom view of the drive socket of FIG. 1 showing the interior of the socket.

While the invention may be susceptible to embodiment in different forms, there is shown in the drawings, and will herein be described in detail, a specific embodiment of the invention with the understanding that the present disclosure is to be considered an exemplification of the principles of the invention, and is not intended to limit the invention to that as illustrated and described herein.

Figure 3:
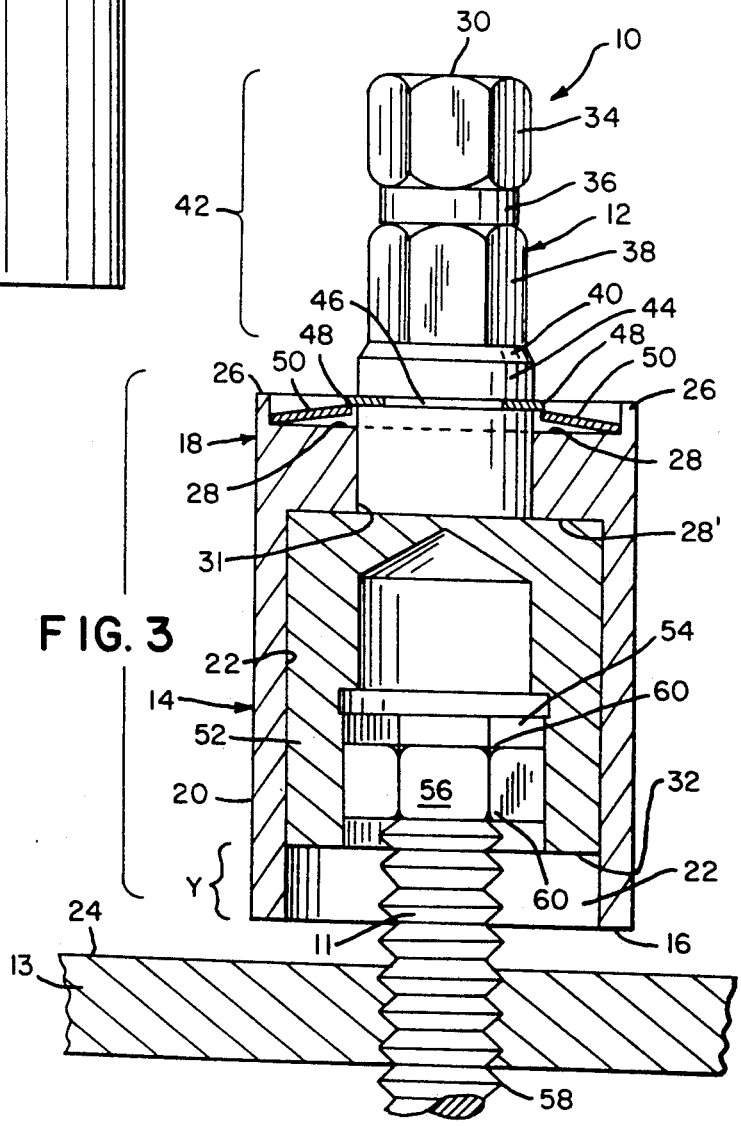
FIG. 3 is a partially sectioned view of the drive socket of FIG. 1 having a fastener disposed within the socket, and driving that fastener into a workpiece.

Referring initially to FIGS. 1 and 3, a drive socket 10, constructed according to the teachings of the present invention, for inserting a fastener 11 into a workpiece 13 is illustrated. The drive socket 10 is composed of a strong material, such as, for example, steel, or other hard metal. The fastener 11 is usually threaded, but that is not necessary. The workpiece 13 can be of any composition.

Generally, the drive socket 10 comprises a movable portion or socket member 12 and a sleeve 14. The sleeve 14 is substantially cylindrical in configuration, having a bottom end 16 and a top end 18 joined by means of a cylindrical body 20. The sleeve 14 is hollow, defining a bore 22 for accepting the movable portion 12, as will be discussed herein.

The bottom end 16 of the sleeve 14 is intended to confront and engage the workpiece 13. Because it is desirable not to damage a surface 24 of the workpiece 13 by engagement with the bottom end 16 of the sleeve 14, the end 16 of the sleeve 14 is preferably substantially smooth and free of burrs. Accordingly, the bottom end 16 of the sleeve 14 forms positive stop means for locating and inserting the fastener 11 into the workpiece 13.

The top end 18 of the sleeve 14 is comprised of an annular flange providing a stop surface 28' engagable with an upper end of a socket section 52 of the socket member 12. The annular flange 26 is substantially perpendicular to the stop surface 28, and extends upwardly a certain distance away from, and substantially parallel to the cylindrical body 20. The stop surface 28' is substantially flat and planar, and extends substantially perpendicularly and radially inwardly from the annular flange 26 towards the center of the sleeve 14. The stop surface 28' does not extend entirely to the center of the sleeve 14, but terminates at the bore 22, which, as described above, extends throughout the sleeve 14. An upper stop surface 28 forms a platform, the function of which will become more clear hereinafter.

Illustrated in FIG. 3 is the construction and external configuration of the movable portion or socket member 12. Generally, the movable portion 12 has a drive shank or tool mount at a tool end 30, and a socket end 32. The drive shank 42 has a diameter substantially smaller than a corresponding diameter of the socket end 32, and extends through a central aperture 31 defined within the annular flange 26. The importance of this diametric relationship will become more clear later. The construction of the movable portion 12, from the tool end 30 to the socket end 32 will now be disclosed in detail.

The shank 42 has a first polygonal section 34 proximate to the tool end 30. The tool end 30 defines one edge of the first polygonal section 34. The polygonal configuration of the polygonal section 34 is preferably hexagonal, however, other configurations are possible, depending upon the configuration of the power tool to which the drive socket 10 is to be connected, as will become clear hereinafter.

The first polygonal section 34 does not extend all the way from the tool end 30 to the socket end 32. The first polygonal section 34 terminates at a substantially circular section 36. The circular section 36 defines an end of the first polygonal section 34 which is disposed opposite the end thereof defined by means of the tool end 30.

An end of the circular section 36 which is disposed opposite the end thereof defined by means of the first polygonal section 34 defines an end of a second polygonal section 38. The construction and configuration of the second polygonal section 38 is substantially similar to that of the first polygonal section 34. However, the second section 38 extends along the shank 42 a distance substantially greater than a corresponding distance along which the first section 34 extends. However, the second section 38 also does not extend entirely from the circular section 36 to the socket end 32. The second section 38 terminates at a beveled section 40.

The tool mount or drive shank 42 allows the drive socket 10 to be mounted upon a power tool, or other suitable source of torque, so that the power tool can apply torsional forces to the socket 10 in order to drive a fastener 11 into a workpiece 13.

The polygonal configurations of the first and second sections 34 and 38 provide points of contact between the drive socket 10 and the power tool in order to facilitate torque transmission, thereby encouraging conjoint rotation of the power tool and the drive socket. In addition, the circular section 36 functions as a recess or detent for accepting a set screw, or other fastening device, provided upon the power tool in order to insure the conjoint rotation of the tool and socket, and also to insure that the drive socket 10 is firmly mounted within the power tool.

An end of the shank 42 disposed opposite the end thereof defined by means of the tool end 30 defines an end of the beveled section 40. The beveled section 40 joins the tool mount or shank 42 to a substantially circular portion 44 which extends from the beveled section 40 towards the socket end 32. The circular portion 44 has a diameter which is substantially larger than the largest diameter of the tool mount 42. The diameter of the circular portion 44 is substantially equal to the diameter of the aperture 31 defined within the annular flange 26 of the sleeve 14 proximate to the stop surface 28.

When the shank 42 is properly inserted into the sleeve 14, the portion 44 extends through and beyond the stop surface 28. A relieved section or annular groove 46 is defined within that part of the circular portion 44 that is interposed between the stop surfaces 28 and 28'. The annular groove 46 has a diameter somewhat smaller than the diameter of the circular portion 44, and is provided for mounting a retaining ring 48 thereon.

After the movable member 12 is inserted into the bore 22 defined within the cylindrical body 20 of the sleeve 14, an actuable member or spring 50 is placed around that part of the circular portion 44 extending beyond the stop surface 28. The spring 50 has a washer-type form having an inner diameter slightly smaller than the diameter which is of the circular portion 44, and an outer diameter substantially equal to the inner diameter defined by means of the upstanding portion of the annular flange 26 disposed upon the top end 18 of the sleeve 14. The spring 50 can be placed around the circular portion 44, and can confront and engage the annular flange 26 and the stop surface 28.

Once the spring 50 has been properly placed around the circular portion 44, it is locked in place, confronting the annular flange 26 and the stop surface 28, by the placement of the retaining ring 48 within the annular groove 46. The retaining ring 48 is usually substantially C-shaped, and snaps into engagement with the annular groove 46. When the retaining ring 48 is in place, the spring 50 is trapped by means of the retaining ring 48 along its inner diameter, and by means of the upstanding portion of the annular flange 26 and the stop surface 28 along its outer diameter.

Figure 4:
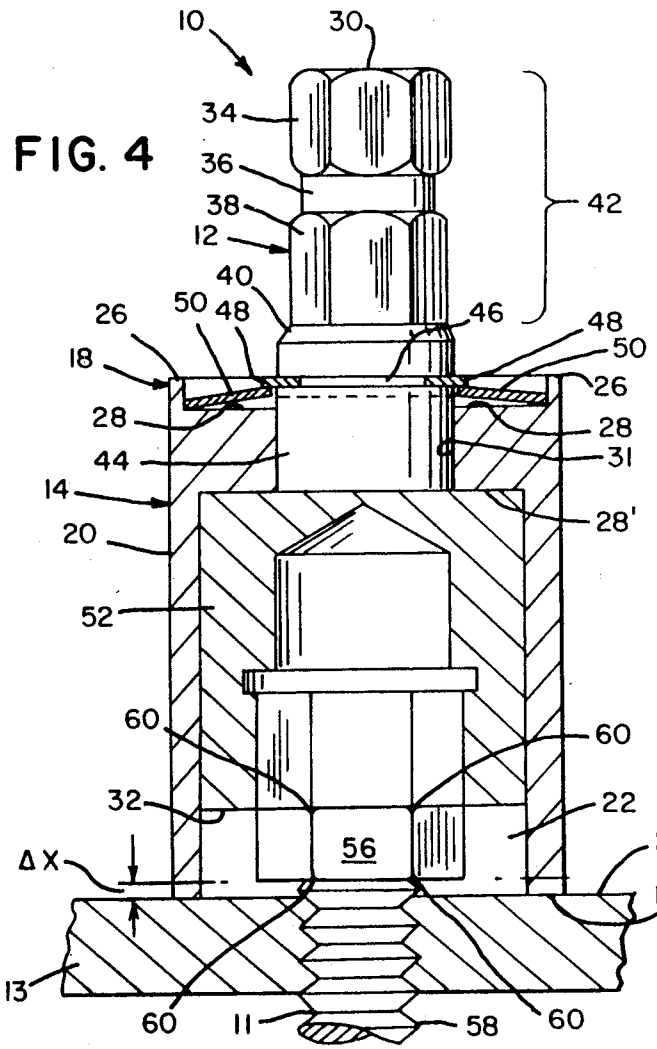
FIG. 4 is a view, similar to that of FIG. 3, illustrating the engagement of the sleeve with the outer surface of the workpiece, and the fastener not being fully seated within the workpiece.

When the spring 50 is so trapped, its outer diameter engages the upstanding portion of the annular flange 26 and the stop surface 28 proximate to their juncture. Thus, as shown in FIG. 3 and FIG. 4, the spring 50 slopes upwardly from the juncture of the upstanding portion of the annular flange 26 and the stop surface 28 towards the retaining ring 48 and the circular portion 44.

Figure 5:
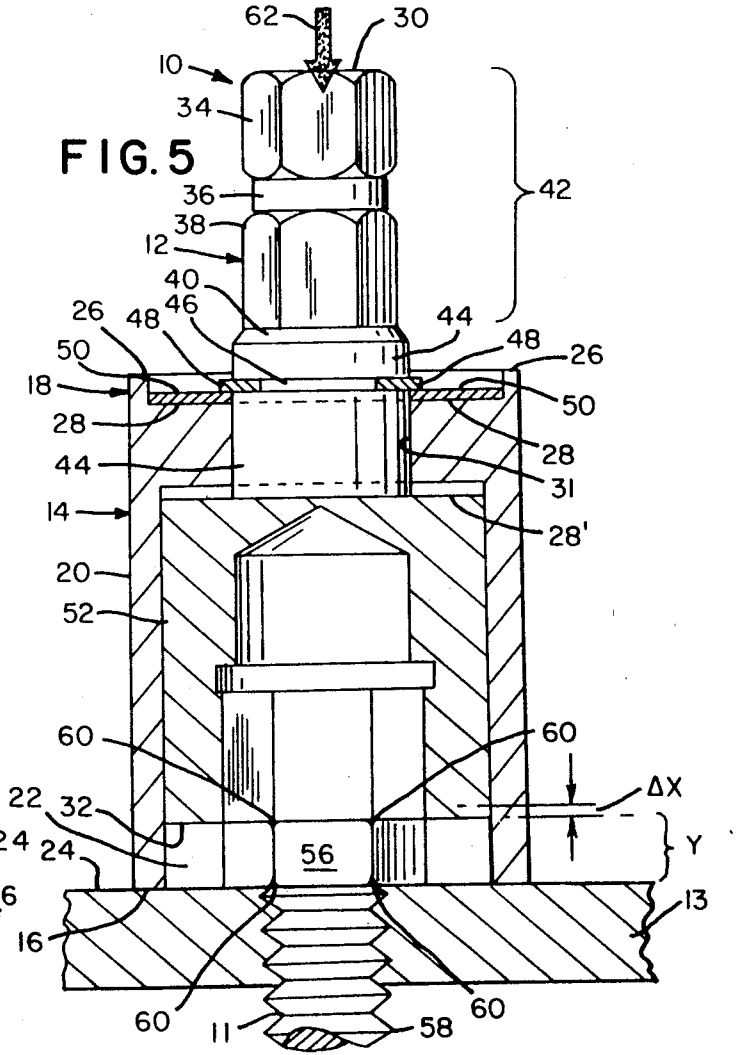
FIG. 5 is a view, similar to that of FIG. 4, illustrating the compression of the spring, thereby allowing the driving engagement between the socket and the fastener to continue until the fastener is fully seated within the workpiece.

Accordingly, as the movable member 12 is axially moved within the bore 22, the spring 50 is correspondingly compressed and 30 relaxed. The relaxed position is defined by means of the spring 50 having the sloped configuration shown in FIG. 3 and FIG. 4, and the compressed position is defined by means of the spring 50 being substantially planar and flat, as shown in FIG. 5. Thus, the upstanding portion of the annular flange 26 and the stop surface 28 comprise a base against which the spring 50 can be compressed. This construction also positively limits the axial motion of the movable member 12. Specifically, the spring 50 and the retaining ring 48 limit the distance through which the movable member 12 can move axially within the bore 22.

The, circular portion 44 defines one end of a socket section 52 of the movable member 12. The socket section 52 is substantially cylindrical in configuration, and extends from the circular portion 44 to the socket end 32. The socket section 52 has a diameter which is substantially larger than a corresponding diameter of any other portion of the movable member 12.

Thus, once the movable member 12 is inserted into the bore 22 within the cylindrical body 20 of, the sleeve 14 through means of the bottom end 16, the stop surface 28' positively restricts the axial movement of the movable member 12 out of the bore 22. In this manner, the retaining ring 48, the spring 50, and the confrontation defined between the diameter of the socket section 52 and the stop surface 28' allow the movable member 12 to move axially within the bore 22 of the sleeve 14 only through means of a distance labeled "Δ X" in FIG. 4. The significance of this distance will become more clear hereinafter.

As illustrated in FIG. 3, the socket section 52 has a socket 54 defined therein for accepting a head 56 of a fastener 11. The socket 54 extends from the socket end 32 a predetermined distance into the socket section 52 so as to accept the head 56 of the fastener 11. The socket 54 has a preferably polygonal configuration which mates with a corresponding polygonal configuration of the head 56. While the socket 54 is illustrated as having a hexagonal configuration, it is to be understood that other shaped configurations can also be used.

When the spring 50 is disposed in the relaxed position, the socket end 32 of the movable member 12 is offset axially upwardly from the bottom end 16 of the sleeve 14 a predetermined specific distance, marked "Y" in FIG. 3. This defines a retracted position of the movable member 12. However, when the spring 50 is disposed at the compressed position and has moved a predetermined distance Δ X, as in FIG. 5, the distance between the socket end 32 and the bottom end 16 of the sleeve 14 is reduced by that same distance Δ X. Accordingly, the distance defined between the socket end 32 and the bottom end 16 of the sleeve 14 is reduced to that indicated by "Y'." It is to be noted that the distance "Y'" is substantially equal to the thickness of the head 56 of the fastener 11, as shown in FIG. 5.

With the structure and construction of the drive socket 10 thusly described, the operation of the same will now be discussed. To utilize the drive socket 10 effectively, it is often mounted within a power tool, such as for example a drill, or other suitable tool, not shown for clarity. Essentially, the power tool mount 42 is inserted into an appropriate socket defined within the power tool so that the power tool can apply a torque to the drive socket 10.

At this point, the drive socket 10 is ready for inserting fasteners 11 into a workpiece 13, The head 56 of a fastener 11 is inserted into the socket 54 defined within the socket section 52 of the drive socket 10. The head 56 of the fastener 11 engages the polygonal periphery of the socket 54. In this manner, any appropriate torque applied to the tool mount 42 will be transferred to the head 56 of the fastener 11, thereby causing the fastener 11 to rotate.

The fastener 11 can now be inserted into the workpiece 13. An entering end of the fastener 11 is engaged against a desired surface of the workpiece 13 at a desired location. The power tool is energized, applying a torque to the tool mount 42, which torque is, in turn, transferred to the fastener 11 by means of the socket 54. Threads 58 defined upon the fastener 11 assist the fastener 11 in boring or drilling through the workpiece 13. The torque application is continued as the fastener 11 drills through the workpiece 13. It is to be noted that at this point in the process, the spring 50 remains in the relaxed position, as illustrated in FIG. 3.

The torque applied by means of the power tool causes the fastener 11 to drill through the workpiece 13. The threads 58 pull the fastener 11 downwardly into the workpiece 13. In order to assist the threads 58, the drive socket 10 is also moved downwardly towards the workpiece 13. Eventually, the bottom end 16 of the sleeve 14 of the drive socket 10 engages the surface of the workpiece 13. The fastener 11 is drilled further into the workpiece 13 until the head 56 becomes disengaged from the socket 54 due to the progressive insertion of the fastener 11 into the workpiece 13. Preferably, the head 56 has rounded edges 60 which assist in the disengagement of the head 56 from the socket 54.

Once the head 56 has disengaged from the socket 54, the fastener 11 is not fully seated within the workpiece 13. Specifically, the head 56 is axially offset upwardly from the surface of the workpiece 13 a predetermined distance labeled Δ X in FIG. 4. The head 56 cannot be further engaged by means of the socket 54 with the spring 50 disposed at the relaxed position.

The drive sockets of the prior art often leave the fastener 11 in this disposition. However, the drive socket 10 is an improvement over the prior art in that the spring 50 allows the socket 54 to be moved downwardly the same specific distance Δ X in order to fully seat the fastener 11 within the workpiece 13.

Specifically, an axially directed force 62, indicated by means of the vertical arrow in FIG. 5, is applied to the movable member 12. The force 62 causes the movable member 12 to shift axially downwardly towards the workpiece 13, thereby compressing the spring 50. As the movable member 12 moves axially within the bore 22, the head 56 of the fastener is again brought into engagement with the socket 54.

The driving of the fastener 11 into the workpiece 13 can now continue. The fastener 11 moves downwardly with respect to the socket 54 through the distance Δ X until the head 56 again becomes disengaged from he socket 54. However, the fastener 11 is now fully seated within the workpiece 13. The torque can now cease, and the drive socket 10 can be withdrawn. The spring 50 moves back to the relaxed position, and the drive socket 10 is ready to insert another fastener 11.

While a preferred embodiment of the present invention has been shown and described, it is envisioned that those skilled in the art may devise various modifications of the present invention without departing from the spirit and scope of the present invention as defined by means of the appended claims. The invention is therefore not intended to be limited by means of the foregoing disclosure, but only by the following appended claims.

The invention claimed is:

1. A drive socket assembly for rotatably driving a threaded fastener into a workpiece such that said fastener is fully seated within said workpiece under proper, non-overtorqued conditions, comprising:

a sleeve member having one end thereof engageable with said workpiece;

a socket member, including a socket recess for engaging a head portion, having a predetermined thickness, of said fastener, rotatably disposed within said sleeve member so as to impart rotary torque to said head portion of said fastener in order to drive said fastener into said workpiece, said socket recess having an open end through which said head portion of said fastener can be engaged so as to impart said rotary drive torque to said fastener from said socket member and through which said head portion of said fastener can be disengaged so as to terminate said rotary drive of said fastener from said socket member, and said socket member also being axially movable within said sleeve member between a first retracted position at which said socket recess initially operatively engages said head portion of said fastener, and a second extended position at which said socket recess secondarily operatively engages said head portion of said fastener; and biasing means operatively interconnecting said socket member to said sleeve member for biasing said socket member toward said first retracted position at which said open end of said socket recess is spaced form said workpiece a first predetermined distance, when said sleeve member is engaged with said workpiece and said fastener has been threadedly driven into said workpiece a first predetermined extent as a result of said initial engagement of said socket recess with said head portion of said fastener, which is greater than said predetermined thickness of said head portion of said fastener such that said head portion of said fastener is able to be disengaged from said socket recess of said socket member such that said fastener is initially driven into said workpiece only through said first predetermined extent, and for permitting said socket member to be axially moved to said second extended position, against the biasing force of said biasing means and under the influence of an axial force imparted to said socket member, at which said socket recess of said socket member secondarily engages said head portion of said fastener, as a result of said open end of said socket recess being spaced a second predetermined distance form said workpiece which is equal to said predetermined thickness of said head portion of said fastener, so as to complete the rotary drive of said fastener into said workpiece, and again disengages form said head portion of said fastener when said fastener has been fully driven into said workpiece, whereby said fastener is threadedly seated within said workpiece under proper, non-overtorqued conditions.

2. A drive socket as described in claim 1 further comprising a tool mount for connecting the drive socket to a source of torque such as a power tool and the like.

3. A socket assembly as set forth in claim 2, wherein said tool mount comprises an annular recess formed within an external peripheral portion thereof for receiving a fastener device for securing said tool mount within said power tool.

4. A socket assembly as set forth in claim 2 wherein said tool mount has an external configuration which is substantially polygonal.

5. A socket assembly as set forth in claim 4, wherein said polygonal configuration of said tool mount comprises a hexagonal configuration.

6. A drive socket as described in claim 1 wherein the biasing means comprises a spring.

7. A drive socket as described in claim 6 wherein the spring is substantially washer-shaped, having an inner diameter sufficient to accept the socket member and an outer diameter engagable with the sleeve so that the spring can be compressed between the socket member and the sleeve by axial movement of the socket member.

8. A drive socket as described in claim 7 further comprising a retaining ring disposed on the socket member, and a stop surface disposed on the sleeve; and the spring being compressible between the retaining ring and the stop surface.

9. A socket assembly as set forth in claim 8, further comprising:

an annular groove defined within an outer peripheral portion of said socket member for receiving said retaining ring.

10. A socket assembly as set forth in claim 8, wherein: said retaining ring has a substantially C-shaped configuration.

11. A drive socket as described in claim 1 further comprising a stop surface located on the sleeve; and the stop surface and the biasing means positively limiting the axial movement of the socket member with respect to the sleeve.

12. A drive socket as described in claim 1 wherein the biasing means comprises a spring compressible between the socket member and the sleeve.

13. A socket assembly as set forth in claim 1, wherein said sleeve member comprises an annular flange portion against which an upper surface portion of said socket member is engaged under the influence of the biasing force of said biasing means when said socket member is biased toward said first retracted position.

14. A socket assembly as set forth in claim 1, wherein said socket recess has a substantially polygonal peripheral configuration for mating with a polygonal peripheral configuration of said head portion of said fastener.

15. A socket assembly as set forth in claim 14, wherein said polygonal configuration of said socket recess comprises a hexagonal configuration.

* * * * *